United States Patent [19]

Carlin

[11] 4,184,941

[45] Jan. 22, 1980

[54] CATALYTIC ELECTRODE

[75] Inventor: William W. Carlin, Portland, Tex.

[73] Assignee: PPG Industries, Inc., Pittsburgh, Pa.

[21] Appl. No.: 927,193

[22] Filed: Jul. 24, 1978

[51] Int. Cl.[2] ..... C25B 11/06

[52] U.S. Cl. ..... 204/292; 427/123; 427/336; 427/352; 427/247; 427/405; 156/656; 156/664

[58] Field of Search ..... 427/336, 352, 247, 123, 427/245; 156/656, 664; 204/146, 284, 292; 429/40, 223; 252/477 R, 477 Q, 425.3

[56] References Cited

U.S. PATENT DOCUMENTS

| | | | |
|---|---|---|---|
| 3,202,552 | 8/1965 | Thexton | 156/664 |
| 3,385,725 | 5/1968 | Schmeckenbecher | 427/123 |
| 3,945,907 | 3/1976 | Gokhale | 204/266 |
| 3,974,058 | 8/1976 | Gokhale | 204/266 |
| 3,992,278 | 11/1976 | Malkin et al. | 204/242 |
| 4,024,044 | 5/1977 | Brannan et al. | 204/242 |

FOREIGN PATENT DOCUMENTS

| | | | |
|---|---|---|---|
| 2527386 | 2/1976 | Fed. Rep. of Germany | 427/126 |
| 2638995 | 3/1977 | Fed. Rep. of Germany | 427/126 |
| 7239444 | 10/1972 | Japan | 156/656 |

*Primary Examiner*—Ralph S. Kendall
*Attorney, Agent, or Firm*—Richard M. Goldman

[57] ABSTRACT

Disclosed is a method of preparing an electrodic surface on a metal substrate by depositing nickel and iron onto the substrate to form a nickel-iron surface and then leaching iron out of the surface to form a porous nickel surface. Also disclosed is an electrode prepared by depositing nickel and iron onto a metal substrate to form a nickel-iron surface, thereafter leaching the iron out of the surface to form a porous nickel surface.

60 Claims, 4 Drawing Figures

CATALYTIC ELECTRODE

DESCRIPTION OF THE INVENTION

In the process of producing chlorine and alkali metal hydroxide, such as potassium hydroxide or sodium hydroxide, by electrolyzing an alkali metal chloride brine, such as an aqueous solution of potassium chloride or an aqueous solution of sodium chloride, the alkali metal chloride solution is fed to the cell, a voltage is imposed across the cell, chlorine is evolved at the anode, alkali metal hydroxide is evolved in the electrolyte in contact with the cathode, and hydrogen is evolved at the cathode. The overall anode reaction is:

$$2Cl^- \rightarrow Cl_2 + 2e^- \quad (1)$$

while the overall cathode reaction is:

$$2H_2O + 2e^- \rightarrow H_2 + 2OH^-. \quad (2)$$

The cathode reaction is reported in the literature to be:

$$H_2O + e^- \rightarrow H_{ads} + OH^- \quad (3)$$

by which the monatomic hydrogen is adsorbed onto the surface of the cathode. In basic media such as would be encountered in the catholyte of a chlor-alkali electrolytic diaphragm cell, the adsorbed hydrogen, adsorbed in reaction (3) above, is reported to be desorbed according to one of two processes:

$$2H_{ads} \rightarrow H_2 \quad (4)$$

or $$H_{ads} + H_2O + e^- \rightarrow H_2 + OH^-. \quad (5)$$

The hydrogen desorption step, that is, either reaction (4) or (5), is reported to be the hydrogen overvoltage controlling step. That is, it is the rate controlling step and its activation energy is related to the cathodic hydrogen overvoltage. The hydrogen evolution potential for the overall cathode reaction (2) is on the order of from about 1.5 to about 1.6 volts versus a saturated Calomel electrode (SCE) on iron in basic media.

According to the method herein disclosed, it has been found that the hydrogen overvoltage may be reduced by about 0.315 to about 0.355 volt by utilizing a cathode having a porous nickel surface prepared by electroless codeposition of iron and nickel followed by leaching the iron out of the surface.

THE FIGURES

DETAILED DESCRIPTION OF THE INVENTION

Figure 1:
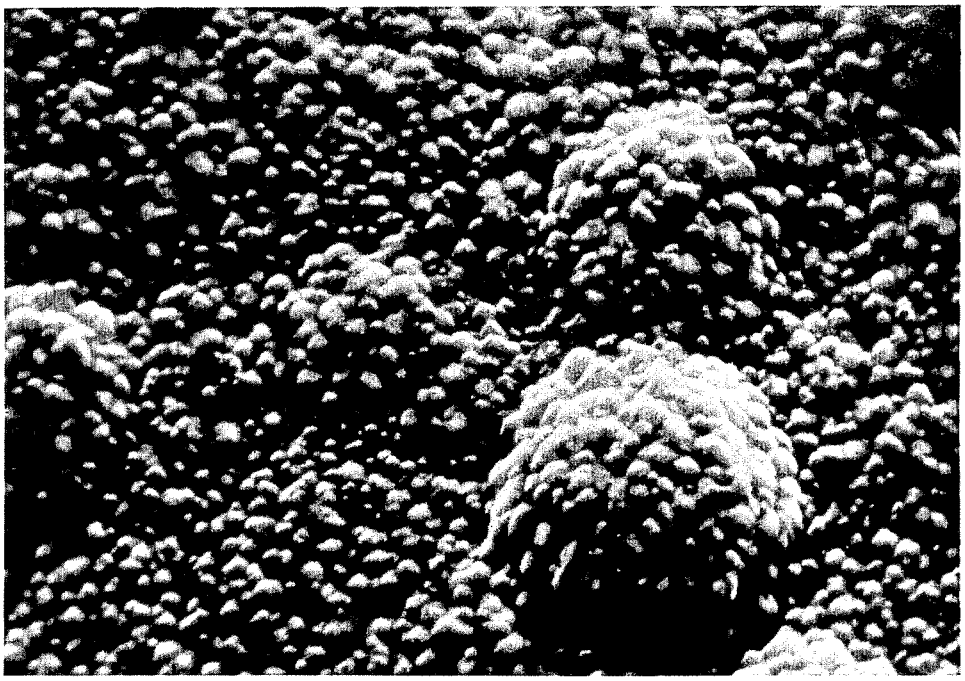
FIG. 1 is a 6500 magnification scanning electron microscope view of a deposited, unleached surface prepared according to the method described herein.

Disclosed in a method of electrolyzing aqueous alkali metal chloride brine such as sodium chloride brine and potassium chloride brine by passing an electrical current through the brine to evolve chlorine at an anode and hydrogen at a cathode. According to the disclosed method, the cathode has a porous nickel surface prepared by codeposition of iron and nickel and subsequent chemical removal of the iron therefrom. Also disclosed is a cathode prepared by codeposition of iron and nickel on a suitable substrate with removal of the iron from the codeposited surface.

Further disclosed herein is an electrolytic cell having an anode, a cathode, and external means for imposing an electrical potential between the anode and the cathode, the electrolytic cell being characterized by a cathode having a surface of porous nickel thereon, prepared by codeposition of iron and nickel and subsequent chemical removal of the iron therefrom.

According to the method disclosed herein, the electrolysis is carried out in an electrolytic cell having a separator between the anolyte and the catholyte compartments. The separator may be a diaphragm, that is, an electrolyte permeable separator as provided by an asbestos diaphragm or a resin treated asbestos diaphragm or a microporous synthetic separator. Alternatively, the separator may be a permionic membrane substantially impermeable to the passage of electrolyte therethrough but permeable to the flow of ions therethrough.

Permeable diaphragms allow anolyte liquor to percolate through the diaphragm.

Alternatively, a perm-selective membrane, that is, a permionic membrane, may be interposed between the anolyte liquor and the catholyte liquor. The perm-selective membrane may be a halocarbon, for example, a fluorocarbon, having acid groups pendant therefrom, such as sulfonyl groups, sulfonamide groups, carboxylic acid groups, phosphoric acid groups, and phosphonic acid groups.

Where either an electrolyte permeable diaphragm or permionic membrane is utilized between the anolyte liquor and the catholyte liquor, the cathode reaction has an electrical potential of about 1.1 volts and, as described above, is:

$$H_2O + 2e^- \rightarrow H_2 + 2OH^-$$

which is the overall reaction for the adsorption step:

$$H_2O + e^- \rightarrow H_{ads} + OH^-$$

and one of the two alternate hydrogen desorption steps:

$$2H_{ads} \rightarrow H_2$$

$$H_{ads} + H_2 + e^- \rightarrow H_2 + OH^-$$

According to the method of this invention, a cathode of reduced hydrogen overvoltage is utilized. The cathode has a metallic substrate with a coating containing porous nickel prepared by the codeposition of iron and nickel and the removal of the iron.

The nickel of the cathodic surface is believed to be either a nickel alloy or a nickel-phosphorous compound, as nickel phosphide. Whenever a nickel coating is referred to herein, it will be understood to include a nickel coating or surface containing phosphorous.

The substrate is an electrically conductive substrate, typically an iron substrate. As used herein, iron includes elemental iron as well as alloys of iron such as steel and alloys of iron with manganese, cobalt, nickel, chromium, molybdenum, vanadium, carbon, and the like.

The substrate is macroscopically permeable to the electrolyte but microscopically impermeable thereto. That is, the substrate is permeable to the bulk flow of electrolyte thereto between individual elements thereof such as between individual rods or wires or perforations but not to the flow of electrolyte into and through the individual elements thereof. The cathode may be a perforated plate, expanded metal mesh, metal rods, or the like.

The electrodic surface of the cathode is characterized by a hydrogen overvoltage of from about 0.04 to about 0.06 volt at a current density of about 190 Amperes per square foot.

The electrodic surface is a porous nickel surface having a porosity of about 0.20 to about 0.50 where porosity is the total volume minus the volume occupied by metal, divided by total volume. The porous metal surface is characterized as being predominantly nickel. By predominantly nickel is meant that the overvoltage characteristics of the surface are primarily those of nickel rather than those of iron. The exact amounts of nickel and iron are not known with particularity but it is believed the major portion of the exposed metal in the pores and interstices is nickel.

The porous nickel surface herein contemplated, i.e., the surface of nickel and phosphorous, is prepared by codeposition of nickel, iron, and phosphorous, followed by chemical removal of the iron. The nickel and iron may be codeposited according to two alternative exemplifications. In one exemplification, a nickel-phosphorous surface is electrolessly deposited upon the substrate followed by electroless codeposition of nickel, phosphorous, and iron. In an alternative exemplification, nickel, phosphorous, and iron are electrolessly codeposited jointly directly upon the surface of the substrate. It is believed that the initial deposit of nickel and phosphorous followed by the codeposition of nickel, phosphorous, and iron results in a more adherent surface upon the substrate.

The nickel and iron may be codeposited electrolytically, for example, from aqueous solution by passing electrical current through the solution utilizing the substrate as a cathode. Alternatively, the codeposited surface may be provided by the thermal decomposition of organo metallic compounds capable of being applied to a substrate and thereafter decompose to deposit metal thereon. According to a preferred exemplification of this invention, the deposition is carried out by the electroless deposition, for example, from hypophosphate solution.

In the electroless deposition from hypophosphite solution, where a nickel surface is deposited first, followed by the codeposition of iron and nickel, the plating bath contains a nickel salt, a cobalt salt, a hypophosphite reducing agent, an acid complexing agent, and a buffer. The buffer and complexing agent may both be the same acid, e.g., an organic acid, or salt, e.g., a salt of an organic acid.

The plating bath above typically is at a pH of from about 5 to 6, which is particularly desirable for the deposition of nickel. The acid component of the plating bath may be citric acid, gluconic acid, tartaric acid, lactic acid, or glycolic acid, or a salt thereof as an alkali metal salt such as a sodium or potassium salt. Particularly preferred is citric acid and the salts thereof such as sodium citrate and potassium citrate. The cobalt is present primarily to enhance the deposition of the nickel and is typically present at a low level, for example, from about 0.001 to about 0.002 weight percent of the plating bath and from about 3 to about 5 weight percent of the total metals although higher or lower levels may be utilized in appropriate circumstances. The reducing agent is a hypophosphite reducing agent, for example, an alkali metal hypophosphite salt or $HPO_2$ acid. The buffer is typically a borate, for example, sodium borate, potassium borate, or boric acid. One particularly desirable bath contains:

TABLE I

| Contents of Electroless Plating Bath Prior to Addition of Iron | |
|---|---|
| Nickel salt as nickelous chloride or nickelous sulfate | 15 grams/liter |
| Cobalt salt as cobaltous chloride or cobaltous sulfate | 0.5 grams/liter |
| Buffer and complexing agent as sodium citrate | 50 grams/liter |
| Buffer as boric acid or sodium borate | 3 grams/liter |
| Reducing agent as sodium hypophosphite | 10 grams/liter |

After initial deposition of the nickel, iron is added to the plating solution, for example, in the form of iron chloride, iron sulfate, iron carbonate, iron citrate, iron gluconate, or the like. The iron content is typically from about 3 to about 11 grams per liter and the iron is usually added in the presence of an acid such as citric acid or the like. The amount of iron added is sufficient to produce a nickel to iron ratio of from about 3:1 to about 1:1 and a pH of from about 8 to about 10 and preferably from about 8.5 to about 9.5. The plating rate increases as a function of hypophosphate content up to from about 1 to about 20 grams per liter of hypophosphate. Thereafter, the plating rate increases less rapidly with increasing hypophosphate concentration. However, the iron to nickel ratio in the plate is particularly sensitive to hypophosphate concentration. At sodium hypophosphate concentrations less than about 10 grams per liter, the ratio of deposited iron to total deposited metals divided by the ratio of iron in the bath to total metals in the bath is greater than about 1, for example, as much as 2 while above about 10 grams per liter the ratio approaches about 1.

The pH of the iron-containing bath is from about 8 to about 10, preferably from about 8.5 to about 9.5.

According to a preferred exemplification of this invention, nickel and phosphorous are first electrolessly plated onto the substrate, whereby to provide better adherence during extended periods of electrolysis. This electroless deposition is carried out at an acidic pH of from about 5 to about 6 and a temperature of from about 85° C. whereby to deposit a coating of from about 5 to about 40 microns at a rate of about 3 to about 5 microns per hour. After the desired level of nickel has been plated, the iron is added to the bath whereby to provide a ratio of nickel to iron of from about 3:1 to about 1:1, acid is then added to the bath in order to control the pH preferably between about 8 and about 10, and according to one particularly desirable embodiment of the invention herein disclosed, from about 8.5 to about 9.5. The combined iron-nickel coat is then deposited at the rate of about 1.5 to about 2 microns per hour, the deposited coating having a thickness of from about 4 to about 6 microns.

Figure 2:
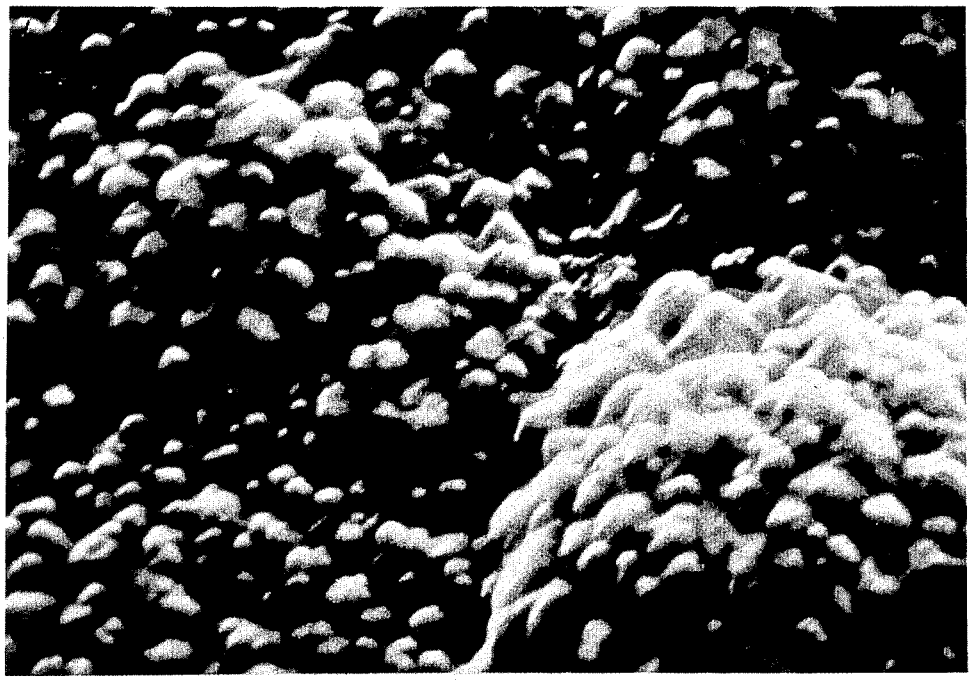
FIG. 2 is a 12,500 magnification scanning electron microscope view of a deposited, unleached surface prepared according to the method described herein.

After electroless deposition of nickel and phosphorous, and the codeposition of nickel, phosphorous, and iron but prior to leaching out the iron, the surface of the cathode is as shown in FIGS. 1 and 2 with smooth, spherical deposits. The coating has a a thickness of from about 9 to about 46 microns and contains iron and nickel with small amounts of cobalt and phosphorous.

Figure 3:
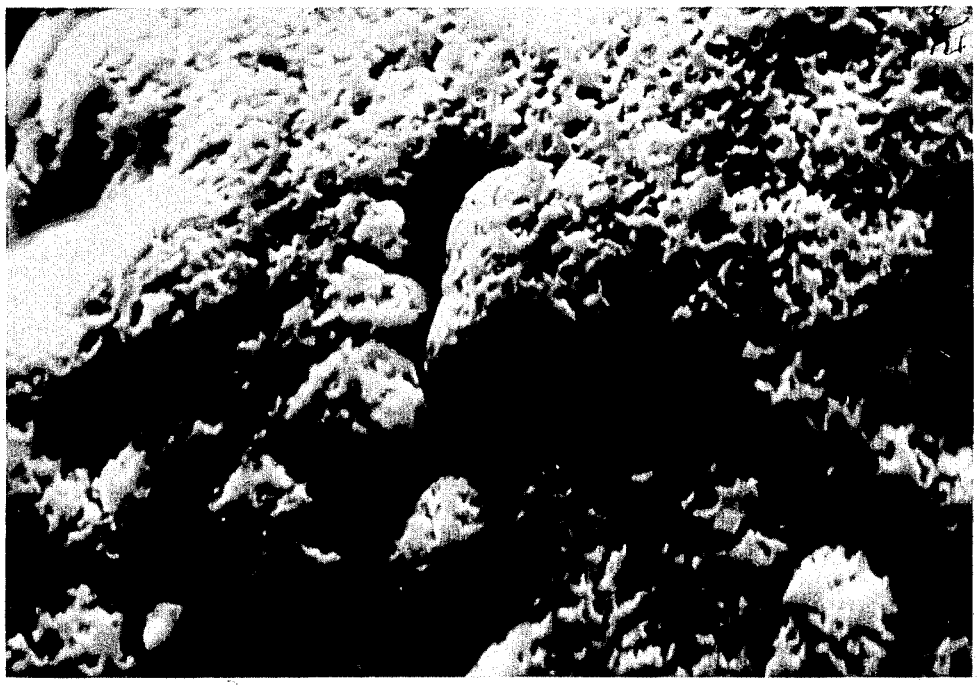
FIG. 3 is a 6500 magnification scanning electron microscope view of a deposited, leached cathodic surface prepared according to the method described herein.
Figure 4:
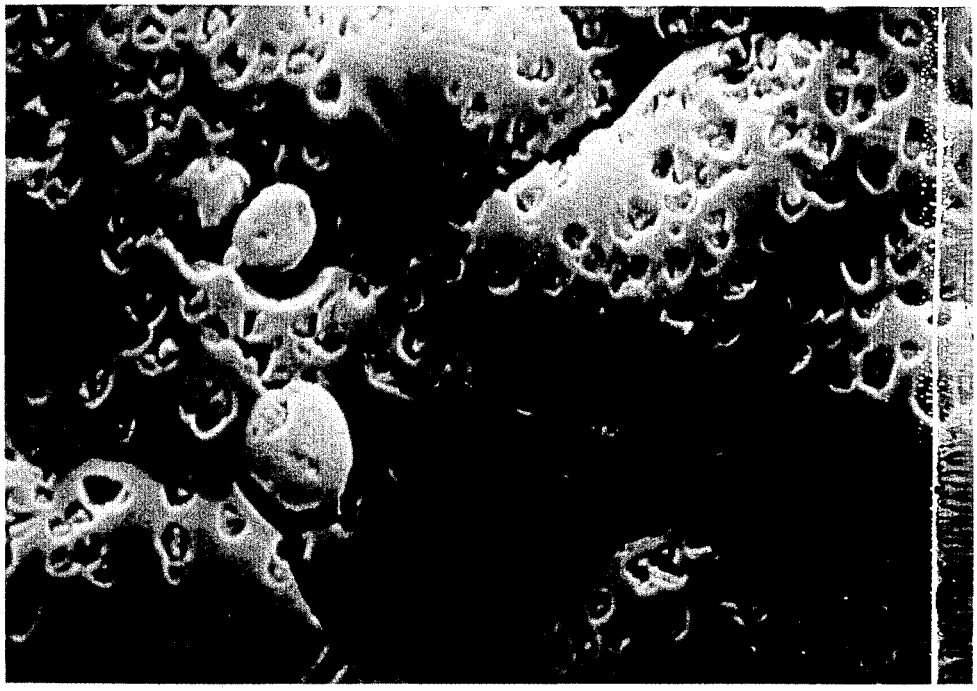
FIG. 4 is a 12,500 magnification scanning electron microscope view of a deposited, leached cathodic surface prepared according to the method described herein.

Thereafter, iron is leached out of the coated surface whereby to provide a porous surface. This surface is as shown in FIGS. 3 and 4. The iron is typically leached out by contacting the surface with a leachant, that is, by inserting or immersing the electrode in a leachant such as a strong acid or a strong alkali in order to leach out sufficient iron to provide a porous, nickel-rich surface.

The amount of iron removed is not critical as long as a sufficient amount of iron is removed to provide an electrocatalytic surface whose principal response to reactants is that of a porous nickel surface.

Preferably, the iron level in the leached surface is low enough to avoid additional leaching of iron into strongly alkaline catholyte liquors as are encountered in permionic cells. The resulting leaching of iron by alkaline catholyte liquors is believed to have deleterious effects upon permionic membranes.

Thus, the unleached surface shown in FIGS. 1 and 2 has an iron content of 22 weight percent and a phosphorous content of 4 weight percent. The leached surface shown in FIGS. 3 and 4 has an iron content of 3 weight percent and a phosphorous content of 6 weight percent.

The leachant is a strong acid or strong alkali that dissolves iron but leaves nickel substantially untouched. Suitable strong acids include acetic acid, haloacetic acid, hydrochloric acid, hydrofluoric acid, nitric acid, sulfuric acid, sulfurous acid, and aqua regia. Preferably the acid is a mineral acid from the group of acids enumerated hereinabove and one particularly desirable acid is 1 normal hydrochloric acid. Such strong alkalis include aqueous alkali metal hydroxides such as potassium hydroxide and sodium hydroxide.

The cathode is immersed in the leachant long enough to provide the porous nickel surface herein contemplated. The minimum time necessary to prepare a cathode useful in a diaphragm cell or a microporous diaphragm cell may be determined by measuring the electrode potential on the surface and removing the surface from the leachant when the potential of the electrode surface is less than about 0.238 volt versus silver-silver chloride electrode. Generally, the amount of iron removed should be sufficient to supply a cathode voltage of from about 0.24 to about 0.238. For use in electrolytic cells having a permionic membrane, the electrode should be leached for a longer period of time in order to avoid leaching of iron in concentrated alkali catholyte liquor solutions.

The following examples are illustrative.

EXAMPLE 1

A cathode was prepared by depositing nickel and phosphorous on a mild steel screen, codepositing iron, phosphorous, and nickel atop the nickel, and then leaching out the deposited iron with hydrochloric acid. The cathode was then tested in an electrolytic cell having a synthetic microporous diaphragm.

A used, mild steel screen cathode was cleaned by immersion in 6 normal hydrochloric acid and then brushed to remove rust. The steel screen measured 5 inches by 7 inches (12.5 centimeters by 17.5 centimeters) with 1/12 inch (1.6 millimeter) mesh spaced 1/32 inch (0.8 millimeter) apart.

An electroless plating bath was prepared containing:

TABLE I

| Initial Plating Solution | | | |
|---|---|---|---|
| Component | Formula | g. | Grams Per Liter |
| Sodium Citrate | $Na_3C_6H_5O_7 . 2H_2O$ | 1200 | 50 |
| Nickelous Chloride | $NiCl_2 . 6H_2O$ | 360 | 15 |
| Cobaltous Chloride | $CoCl_2 . 6H_2O$ | 12 | 0.5 |
| Sodium Hypophosphite | $NaH_2PO_2 . H_2O$ | 240 | 10 |
| Sodium Borate | $Na_2B_4O_7 . 10H_2O$ | 72 | 3 |
| Water - balance to make 24 liters | | | |

Plating was commenced at an initial pH of 8.12. The pH was adjusted to 6.10–6.20. After about 3 hours of plating, 120 grams (5 grams/liter) of $FeSO_4.7H_2O$ was added to the solution, dropping the pH to 5.87. Sodium carbonate was added to adjust the pH to 6.0. Thereafter, 1200 grams (50 grams/liter) of sodium citrate was added to buffer the solution, the pH was adjusted to 8.3 by the addition of $Na_2CO_3$, and 200 grams (8.16 grams/liter) of $FeSO_4.7H_2O$ was added. The pH was adjusted to 9.1. The cathode was then placed in the bath for 2 hours and 50 minutes, removed and dipped in 6 normal HCl for 10 seconds. The pH of the solution was adjusted to 8.9. The cathode was placed back in the electroless plating solution for 2 hours and 25 minutes. The cathode was then removed from the electroless plating solution and soaked in 6 normal HCl for one hour.

The cathode was then installed in a laboratory electrolytic cell having a ruthenium dioxide-titanium dioxide coated titanium anode. The anode was spaced 1 inch (25 millimeters) from the cathode with a DuPont NAFION® 715 microporous diaphragm therebetween.

Electrolysis was commenced at a current density of 190 Amperes per square foot (21 Amperes per square decimeter) and carried out for 14 days. The cathode potential was 1.15 to 1.17 volt on the front surface of the cathode and 1.12 to 1.14 volt on the back surface of the cathode.

EXAMPLE 2

A cathode was prepared by depositing nickel on a 1 inch by ½ inch by 1/16 inch (2.5 centimeter by 1.25 centimeter by 1.6 millimeter) coupon, codepositing iron and nickel atop the deposited nickel and then leaching out the deposited iron with hydrochloric acid.

An electroless plating bath was prepared containing:

TABLE II

| Plating Solution | | |
|---|---|---|
| Component | Formula | Grams Per Liter |
| Sodium Citrate | $Na_3C_6H_5O_7 . 2H_2O$ | 50.0 |
| Nickelous Chloride | $NiCl_2 . 6H_2O$ | 15.0 |
| Cobaltous Chloride | $CoCl_2 . 6H_2O$ | 0.5 |
| Sodium Hypophosphite | $NaH_2PO_2 . H_2O$ | 10.0 |
| Sodium Borate | $Na_2B_4O_7 . 10H_2O$ | 3.0 |
| Water | | balance |

The pH of the bath was adjusted to 6.7 and the coupon was placed in the bath and plated for 2 hours and 15 minutes. At that time, 5 grams per liter of $FeSO_4.7H_2O$ was added to the plating solution and the plating continued for 2 hours and 45 minutes.

The plating solution was then fortified by the addition of 8.33 grams per liter of $FeSO_4.10H_2O$ and plating was continued for 4 hours.

The coupon was then removed from the plating solution and dipped in aqueous hydrochloric acid. When the gas evolution slowed down, the coupon was removed and tested as a cathode. It had a cathode potential versus a silver-silver chloride reference electrode of 1.15 volts.

While the invention has been described with respect to certain exemplifications and embodiments thereof, the invention is not to be limited except as in the claims appended hereto.

I claim:

1. A method of preparing an electrodic surface on a metal substrate comprising:

(a) depositing nickel and iron onto said substrate to form a nickel-iron surface; and (b) leaching iron out of said surface to form a porous surface.

2. The method of claim 1 comprising depositing said iron-nickel surface from an electroless plating bath.

3. The method of claim 2 wherein said electroless plating bath is a hypophosphite bath.

4. The method of claim 3 comprising depositing said iron-nickel surface from the hypophosphite electroless plating bath until the surface is more than about 5 microns thick.

5. The method of claim 1 comprising leaching iron out of said surface while leaving nickel substantially in place.

6. The method of claim 5 comprising measuring the potential of the iron-nickel surface and maintaining leachant in contact with the surface until the cathodic electrode potential of the surface stabilizes at 0.238 volt versus a silver-silver chloride electrode.

7. The method of claim 5 wherein the leachant is a mineral acid.

8. The method of claim 7 wherein the mineral acid is hydrochloric acid.

9. The method of claim 8 wherein the mineral acid is hydrochloric acid.

10. The method of claim 1 comprising first depositing nickel onto said substrate to form a nickel film and thereafter codepositing iron and nickel atop said nickel film.

11. The method of claim 10 comprising depositing the nickel film from an electroless plating bath.

12. The method of claim 11 wherein the electroless plating bath is a hypophosphite bath.

13. The method of claim 12 comprising depositing the nickel film out of the hypophosphite electroless plating bath until the nickel film is at least about 5 microns thick.

14. An electrode prepared by the method comprising:

(a) depositing nickel and iron onto a metal substrate to form a nickel-iron surface; and (b) leaching iron out of said surface to form a porous surface.

15. The electrode of claim 14 prepared by depositing said iron-nickel surface from an electroless plating bath.

16. The electrode of claim 15 wherein the electroless plating bath is a hypophosphite bath.

17. The electrode of claim 16 prepared by depositing said iron-nickel surface from the hypophosphite electroless plating bath until the surface is more than about 5 microns thick.

18. The electrode of claim 14 prepared by leaching iron out of said surface while leaving nickel substantially in place.

19. The electrode of claim 18 prepared by measuring the potential of the iron-nickel surface and maintaining leachant in contact with the surface until the cathodic electrode potential of the surface stabilizes at 0.238 volt versus a silver-silver chloride electrode.

20. The electrode of claim 18 wherein the leachant is a mineral acid.

21. The electrode of claim 20 wherein the mineral acid is hydrochloric acid.

22. The electrode of claim 14 prepared by first depositing nickel onto said substrate to form a nickel film and thereafter codepositing iron and nickel atop said nickel film.

23. The electrode of claim 22 prepared by depositing the nickel film from an electroless plating bath.

24. The electrode of claim 23 wherein the electroless plating bath is a hypophosphite bath.

25. The electrode of claim 24 prepared by depositing the nickel film out of the hypophosphite electroless plating bath until the nickel film is at least about 5 microns thick.

26. A method of preparing an electrodic surface on a metal substrate comprising:

(a) first depositing nickel onto said substrate to form a nickel film;

(b) thereafter depositing nickel and iron atop said nickel film to form a nickel-iron surface; and (c) leaching iron out of said nickel-iron surface to form a porous surface.

27. The method of claim 26 comprising depositing said iron-nickel surface from an electroless plating bath.

28. The method of claim 27 wherein said electroless plating bath is a hypophosphite bath.

29. The method of claim 28 comprising depositing said iron-nickel surface from the hypophosphite electroless plating bath until the surface is more than about 5 microns thick.

30. The method of claim 26 comprising leaching iron out of said surface while leaving nickel substantially in place.

31. The method of claim 30 wherein the leachant is a mineral acid.

32. The method of claim 31 wherein the mineral acid is hydrochloric acid.

33. The method of claim 32 wherein the mineral acid is hydrochloric acid

34. The method of claim 30 comprising measuring the potential of the iron-nickel surface and maintaining leachant in contact with the surface until the cathodic electrode potential of the surface stabilizes at 0.238 volt versus a silver-silver chloride electrode.

35. The method of claim 26 comprising depositing the nickel film from an electroless plating bath.

36. The method of claim 35 wherein the electroless plating bath is a hypophosphite bath.

37. The method of claim 36 comprising depositing the nickel film out of the hypophosphite electroless plating bath until the nickel film is at least about 5 microns thick.

38. A method of preparing an electrodic surface on a metal substrate comprising:

(a) depositing nickel and iron onto said substrate from an electroless plating bath whereby to form a nickel-iron surface; and (b) leaching iron out of said surface to form a porous surface.

39. The method of claim 38 wherein said electroless plating bath is a hypophosphite bath.

40. The method of claim 39 comprising depositing said iron-nickel surface from the hypophosphite electroless plating bath until the surface is more than about 5 microns thick.

41. The method of claim 38 comprising leaching iron out of said surface while leaving nickel substantially in place.

42. The method of claim 41 comprising measuring the potential of the iron-nickel surface and maintaining leachant in contact with the nickel-iron surface until the cathodic electrode potential of the surface stabilizes at 0.238 volt versus a silver-silver chloride electrode.

43. The method of claim 41 wherein the leachant is a mineral acid.

44. The method of claim 43 wherein the mineral acid is hydrochloric acid.

45. The method of claim 44 wherein the mineral acid is hydrochloric acid.

46. The method of claim 38 comprising first depositing nickel onto said substrate to form a nickel film and thereafter codepositing iron and nickel atop said nickel film.

47. The method of claim 46 comprising depositing the nickel film from an electroless plating bath.

48. The method of claim 47 wherein the electroless plating bath is a hypophosphite bath.

49. The method of claim 48 comprising depositing the nickel film out of the hypophosphite electroless plating bath until the nickel film is at least about 5 microns thick.

50. An electrode prepared by the method comprising:

(a) depositing nickel onto a metal substrate to form a nickel film thereon;

(b) depositing nickel and iron atop said nickel film to form a nickel-iron surface; and (c) leaching iron out of said nickel-iron surface to form a porous surface.

51. The electrode of claim 50 prepared by depositing said iron-nickel surface from an electroless plating bath.

52. The electrode of claim 51 wherein the electroless plating bath is a hypophosphite bath.

53. The electrode of claim 52 prepared by depositing said iron-nickel surface from the hypophosphite electroless plating bath until the surface is more than about 5 microns thick.

54. The electrode of claim 50 prepared by leaching iron out of said nickel-iron surface while leaving nickel substantially in place.

55. The electrode of claim 54 wherein the leachant is a mineral acid.

56. The electrode of claim 55 wherein the mineral acid is hydrochloric acid.

57. The electrode of claim 54 prepared by measuring the potential of the iron-nickel surface and maintaining leachant in contact with the surface until the cathodic electrode potential of the surface stabilizes at 0.238 volt versus a silver-silver chloride electrode.

58. The electrode of claim 50 prepared by depositing the nickel surface from an electroless plating bath.

59. The electrode of claim 58 wherein the electroless plating bath is a hypophosphite bath.

60. The electrode of claim 59 prepared by depositing the nickel film out of the hypophosphite electroless plating bath until the nickel film is at least about 5 microns thick.

* * * * *